US005776643A

United States Patent [19]

Hirai

[11] Patent Number: 5,776,643

[45] Date of Patent: Jul. 7, 1998

[54] LIGHT-SENSITIVE MATERIAL FOR COLOR FILTER AND PROCESS FOR PRODUCING COLOR FILTER USING THE SAME

[75] Inventor: Hiroyuki Hirai, Kanagawa, Japan

[73] Assignee: Fuji Photo Film Co., Ltd., Kanagawa, Japan

[21] Appl. No.: 852,122

[22] Filed: May 6, 1997

Related U.S. Application Data

[63] Continuation of Ser. No. 370,878, Jan. 10, 1995.

[30] Foreign Application Priority Data

Jan. 11, 1994 [JP] Japan ..... 6-001363
Dec. 7, 1994 [JP] Japan ..... HEI 6-303977

[51] Int. Cl.[6] ..... G03C 1/74; G03C 1/76

[52] U.S. Cl. ..... 430/7; 430/256; 430/259; 430/262; 430/426; 430/641

[58] Field of Search ..... 430/7, 256, 259, 430/262, 426, 641

[56] References Cited

U.S. PATENT DOCUMENTS 5,254,447 10/1993 Meyer et al. ..... 430/259
5,543,273 8/1996 Smith et al. ..... 430/262

FOREIGN PATENT DOCUMENTS 61-48834 3/1986 Japan .
62-71950 4/1987 Japan .
62-148952 7/1987 Japan .
63-261361 10/1988 Japan .
1-255858 10/1989 Japan .

OTHER PUBLICATIONS

English Language abstract for JP–A–1–255858.

*Primary Examiner*—Mark F. Huff
*Attorney, Agent, or Firm*—Sughrue, Mion, Zinn, Macpeak & Seas, PLLC

[57] ABSTRACT

A light-sensitive material for a color filter is described, which comprises a support having provided thereon a peeling layer and further provided thereon at least three silver halide emulsion layers which are different in color sensitivity. A process for producing a color filter is also described, which comprises the steps of adhering an emulsion side of the light-sensitive material to a light-transmitting substrate, peeling the support off the light-sensitive material, pattern-exposing the emulsion side, and subjecting the material to development processing and desilvering processing.

7 Claims, 1 Drawing Sheet

LIGHT-SENSITIVE MATERIAL FOR COLOR FILTER AND PROCESS FOR PRODUCING COLOR FILTER USING THE SAME

This is a Continuation of Application No. 08/370,878 filed Jan. 10, 1995.

FIELD OF THE INVENTION

This invention relates to a light-sensitive material for a color filter, a color filter and a process for producing the color filter and more particularly to a process for easily preparing a color filter having excellent spectral transmission characteristics.

BACKGROUND OF THE INVENTION

A color filter is used in a color face plate for, for example, CRT display, a photoelectric element plate for copying, a filter for single tube type TV cameras, a flat panel display using liquid crystals, and a color solid-state image sensor.

Generally employed color filters comprise regularly arranged three primary colors, i.e., blue, green and red. Color filters comprising four or more hues are also available for some uses. For example, color filers for camera tubes or for liquid crystal displays are required to have a black pattern for various purposes.

Known processes for producing these color filters include vacuum evaporation, dyeing, printing, pigment dispersion, electrodeposition, and resist electrodeposition transfer. However, color filters obtained by these processes have their several disadvantages, such as involvement of a complicated step, liability to pinholes or scratches, poor yield, and insufficient precision.

In order to overcome these disadvantages, methods of producing color filters by coupler-in-emulsion type development (for example, JP-A-62-148952, JP-A-62-71950, JP-A-63-261361) or coupler-in-developer type development (for example, JP-A-556342) each using a silver halide color light-sensitive material has been studied (the term "JP-A" as used herein means an "unexamined published Japanese patent application). Since the latter development method requires at least three steps of color development, the processing steps are not easy. However, both the methods requires a light-sensitive material having a multi-layer structure, and formation of light-sensitive layers on such a hard substrate as a glass plate involves repetition of spin coating. Therefore, these processes are not sufficiently easy and simple to carry out.

On the other hand, light-sensitive materials having a peeling layer are described in JP-A-1-255858 and JP-A-61-48834.

SUMMARY OF THE INVENTION

An object of the present invention is to provide a color filter having excellent spectral transmission characteristics and a process for producing the same, which process requires no complicated step and is suitable for mass production.

In other words, an object of the present invention is to provide a process for easily producing a color filter on a hard light-transmitting substrate such as a glass plate.

Another object of the present invention is to provide a micro color filter having high precision which comprises blue, green and red portions with excellent spectral transmission characteristics having no loss of color definition and a black portion with excellent spectral absorption characteristics.

These and other objects of the present invention have been accomplished by a light-sensitive material for a color filter comprising a support having provided thereon a peeling layer and further provided thereon at least three silver halide emulsion layers which are different in color sensitivity.

Further, these and other objects of the present invention have been accomplished by a process for producing a color filter comprising the steps of adhering an emulsion side of the above-described light-sensitive material to a light-transmitting substrate, peeling the support off the light-sensitive material, pattern-exposing the emulsion side, and subjecting the material to development processing and desilvering processing.

Moreover, these and other objects of the present invention have been accomplished by a color filter prepared by the above-described process.

DETAILED DESCRIPTION OF THE INVENTION

Figure 1:
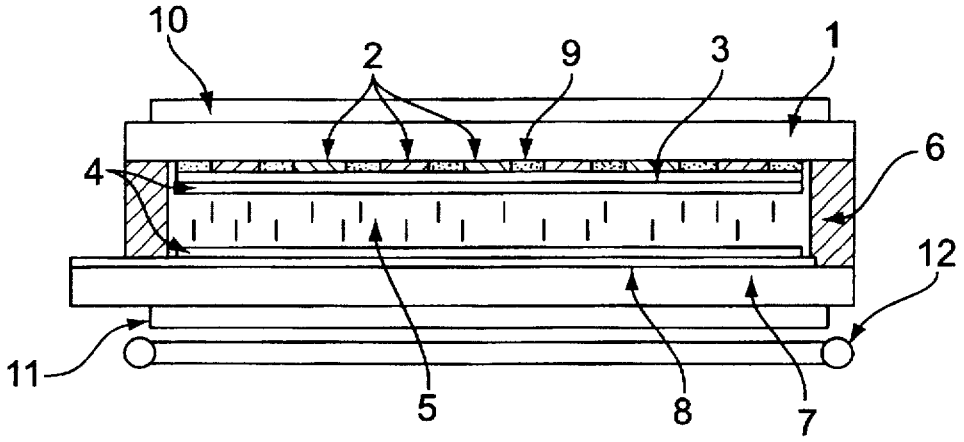
FIG. 1 illustrates an example of a color liquid crystal filter using a color filter according to the present invention.

Binders or protective colloids which can be used in silver halide emulsion layers, intermediate layers or protective layers of the light-sensitive material according to the present invention include gelatin and other hydrophilic polymers, with gelatin being advantageous. Examples of the hydrophilic polymers other than gelatin include homo- or copolymers, such as polyvinyl alcohol, polyvinyl alcohol partial acetal, polyvinyl butyral, poly-N-vinylpyrrolidone, polyacrylic acid, polyacrylamide, polyvinylimidazole, polyvinylpyrazole, carrageenan, gum arabic, and cellulose derivatives, such as hydroxyalkyl cellulose, carboxymethyl cellulose, cellulose sulfate, cellulose acetate hydrogen phthalate, and sodium alginate.

Graft polymers of gelatin and other high polymers are also effective. For example, gelatin to which a homo- or copolymer of a vinyl monomer, such as acrylic acid, (meth) acrylic acid or a derivative thereof (e.g., an ester or an amide), acrylonitrile or styrene, is grafted can be used. In particular, graft polymers of gelatin and a polymer which is compatible with gelatin to some extent, such as (meth) acrylic acid, (meth)acrylamide or a hydroxyalkyl methacrylate, are preferred. Examples of these graft copolymers are described in U.S. Pat. Nos. 2,763,625, 2,831,767, and 2,956,884, and JP-A-5665133.

Typical synthetic hydrophilic high polymers which can be used in the present invention are described in, e.g., West German Patent Publication (OLS) 2,312,708, U.S. Pat. Nos. 3,620,751 and 3,879,205, and JP-B-43-7561 (the term "JP-B" as used herein means an "examined Japanese patent publication").

The above-mentioned hydrophilic polymers may be used either individually or in combination of two or more thereof.

Gelatin species which can be used in the present invention include alkali-processed gelatin, acid-processed gelatin, enzyme-processed gelatin, and a mixture thereof. Gelatin derivatives obtained by reacting gelatin with various compounds, such as an acid halide, an acid anhydride, an isocyanate compound, bromoacetic acid, an alkanesultonic acid, a vinylsulfonamide compound, a maleinimide compound, a polyalkylene oxide, and an epoxy compound are also useful. Specific examples of the gelatin derivatives are given in U.S. Pat. Nos. 2,614,928, 3,132,945, 3,186,846, and 3,312,553, British Pat. Nos. 861,414, 1,033,189, and 1,005,784, and JP-B-42-26845. Further, in the present specification, "gelatin" often includes gelatin and gelatin derivatives.

It is preferable that all layers constituting the light-sensitive material of the present invention other than a peeling layer each contains a binder mainly comprising gelatin or a derivative thereof while the peeling layer mainly comprises a polymer other than gelatin or a gelatin derivative. The term "binder mainly comprising gelatin or a derivative thereof" as used herein means that gelatin or a gelatin derivative forms a proportion of at least 80% of the total binder. Similarly, in the peeling layer, the proportion of hydrophilic polymers other than gelatin (or gelatin derivatives) is preferably 80% or more based on the total binder. The binder of the peeling layer may comprise a single hydrophilic polymer or a combination of two or more hydrophilic polymers. Gelatin or a gelatin derivative or a dispersion of a hydrophobic compound may be contained in the binder as long as the proportion of hydrophilic polymers are 80% or more.

The peeling layer in the present invention is a layer mainly comprising a cellulose derivative. That is, the hydrophilic polymer to be used in the peeling layer is preferably a cellulose derivative, more preferably a hydroxyalkyl cellulose. Examples thereof include hydroxyethyl cellulose, hydroxypropyl cellulose, hydroxypropylmethyl cellulose and a mixture thereof. The peeling layer is coated in an amount of from 0.02 to 2.0 g/m$^2$, more preferably from 0.05 to 1.0 g/m$^2$.

In the present invention, a layer mainly comprising gelatin or a gelatin derivative is preferably provided on at least one of layers directly contacting with the peeling layer. In this layer, gelatin or a gelatin derivative is preferably contained in a proportion of 80% or more. The remainder, i.e., about 20% or less, may contain the aforesaid hydrophilic polymers or a hydrophobic compound dispersion. This layer mainly comprising gelatin or a gelatin derivative is preferably coated in an amount of from 0.01 to 2.0 g/m$^2$, more preferably from 0.05 to 1.0 g/m$^2$.

The binders (hydrophilic polymers) excluding those used in the peeling layer of the present invention are used in a total amount of 20 g/m$^2$ or less, preferably 10 g/m$^2$ or less, and more preferably from 2 to 8 g/m$^2$.

In the present invention, the emulsion side of the silver halide light-sensitive material is pattern exposed and color development is carried out to obtain a color image after the emulsion side thereof is adhered to a light-transmitting substrate. This is of great importance for assuring high precision. On the other hand, if the emulsion side is adhered to a light-transmitting substrate after a color image is formed on a light-sensitive material, the pattern image may be often distorted at the time of adhesion because the emulsion side is thin and soft.

The emulsion side of a silver halide light-sensitive material can be adhered to a light-transmitting substrate via a commercially available adhesive with which the substrate and the emulsion layer, particularly a protective layer, of the light-sensitive material may be bonded together; The adhesive to be used can be selected from among various adhesives, such as thermosetting resin adhesives, thermoplastic resin adhesives, elastomer adhesives, and polymer alloy adhesives, according to the material of the adherents. For example, for bonding a glass substrate and an emulsion layer or a protective layer whose binder mainly comprises gelatin, epoxy polymer alloy adhesives are preferred.

When the binder of layers other than the peeling layer mainly comprises gelatin, adhesion of the emulsion side (or protective layer) of the present invention to a substrate, particularly a glass substrate, is preferably carried out as follows. A solution containing gelatin or a gelatin derivative and colloidal silica is previously applied to the adhered surface of the glass substrate (for example, by means of a spin coater), and the emulsion side, particularly the protective layer, of the light-sensitive material is laminated thereon, followed by heat adhering by means of, for example, a laminator, an iron, and a hot press. The mixing ratio of gelatin or a gelatin derivative and colloidal silica is from 10:1 to 1:10 by weight. The colloidal silica preferably has an average particle size of 0.5 μm or less, more preferably 0.1 μm or less. The heat adhering is conducted at a temperature of from 60° to 180° C. for an arbitrarily set time, preferably from 0.1 to 60 seconds. The heat adhering may be effected in the presence of a trace amount of water.

In the above method, it is preferable that the support of the light-sensitive material after heat adhering is peeled off and removed (in this processing, it is preferred that a relative humidity is adjusted to 50% or more in order to inhibit generation of static electricity), the pattern exposure is carried out, and then hardening processing is carried out prior to the development processing. Hardening agents known in the art, such as aldehyde compounds, ethyleneimine derivatives, isoxazole derivatives, epoxy compounds, vinylsulfone compounds, acryloyl compounds, carbodiimide compounds, cyanuric, chloride derivatives, maleimide derivatives, acetylene compounds, methanesulfonic ester compounds, chromium alum, and potassium alum, can be used. They are used alone or in combination thereof. When multiple color filters are prepared on one substrate, layers such as light-sensitive layers in unnecessary portions may be resolved and removed by using, e.g., an enzyme solution. This processing may be carried out before or after the hardening processing or during any processing steps described below.

In the present invention, materials which are transparent and have optical isotropy and sufficient heat resistance are preferred as the material constituting the light-transmitting substrate, and examples thereof include those made of polyethylene terephthalate, polybutylene terephthalate, polyethylene naphthalate, polystyrene, polycarbonate, polyether sulfone, cellulose acetate, polyarylate, soda-lime glass, borosilicate glass, and quartz.

The surface of the substrate may be subjected to undercoating processing, if necessary. Further, surface processing, such as glow discharge, corona discharge, and ultraviolet irradiation, may be conducted.

The light-transmitting substrate may be used in the form of, for example, a plate, a sheet, a film. The thickness of the substrate can be selected appropriately according to the purpose and the material and is usually from 0.01 to 10 mm. For example, a glass substrate usually has a thickness of from 0.3 to 3 mm.

The light-sensitive materials which can be used for preference in the present invention include coupler-indeveloper type color reversal films, coupler-in-emulsion type color reversal films, color negative films by color negative processing, color films for displays, and auto positive color films. For the details of these light-sensitive materials, refer to T.H. James (ed.), The Theory of the Photographic Process, 4th Ed., MacMillan (1977) or Kaaku Shashin Binran I, pp. 559–564 & 569, Maruzen Co., Ltd. Additionally, coupler-inemulsion type color films containing two or more couplers capable of developing different hues on color development in the same light-sensitive silver halide emulsion layer as described in JP-A-63-261361 and coupler-in-developer type color films which are developed with a developer containing one developing agent and two or more couplers capable of developing different colors for the same light-sensitive silver halide as described in JP-A-64-79701 are also employable.

The light-sensitive material and the method for processing the same which can preferably be used in the present invention will be explained below.

Silver halides in the light-sensitive silver halide emulsion layers used in the present invention preferably include silver chloride, silver chlorobromide, silver bromide, silver iodobromide, and silver chloroiodobromide. The average iodide content is preferably 3 mol% or less, more preferably 0 mol%. Substantially pure silver bromide or chloride is more preferred.

The silver halide grains in emulsions may have a regular crystal form, such as a cubic form, an octahedral form or a tetradecahedral form, an irregular crystal form, such as a spherical form or a plate form, a crystal form having a crystal defect, such as a twinning plane, or a composite crystal form thereof. Cubic grains or octahedral grains are particularly preferred.

The silver halide grains may have a wide range of grain size, including from fine grains of about 0.2 μm or smaller to giant grains having a projected area diameter reaching about 10 μm. While either a mono-dispersed emulsion or a polydispersed emulsion is used, a mono-dispersed emulsion having a grain size ranging from 0.1 to 1.5 μm with a coefficient of variation of 15% or less is preferred.

The silver halide emulsions can be prepared by the processes described in, e.g., *Research Disclosure* (hereinafter abbreviated as *RD*), Vol. 176, No. 17643 (Dec., 1978), pp. 2223, "I. Emulsion Preparation and Types", *ibid*, No. 18716 (Nov., 1979), p. 648, P. Glafkides, *Chemic et Phisigue Photographique*, Paul Montel (1967), G.F. Duffin, *Photographic Emulsion Chemistry*, Focal Press (1966), and V.L. Zelikman et al., *Making and Coating Photographic Emulsion*, Focal Press (1964).

Mono-dispersed emulsions described in U.S. Pat. Nos. 3,574,628 and 3,655,394 and British Pat. No. 1,413,748 are preferably used as well.

Tabular grains having an aspect ratio of about 5 or more are also useful. Such tabular grains can easily be prepared by the processes described, e.g., in Gutoff, *Photographic Science and Engineering*, Vol. 14, pp. 248–257 (1970), U.S. Pat. Nos. 4,434,226, 4,414,310, 4,433,048, and 4,439,520, and British Pat. No. 2,112,157.

The silver halide grains may have a uniform crystal structure throughout the individual grains or may be heterogeneous grains including those composed of a core and an outer shell or layers different in halogen compositions, and those having fused thereto silver halide of different halogen composition through epitaxy. Silver halide grains fused with compounds other than silver halides, e.g., silver rhodanide or lead oxide may also be used. A mixture comprising grains of various crystal forms is employable.

Silver halide emulsions are usually subjected to physical ripening, chemical ripening, and spectral sensitization. Additives which can be used in these steps are described in *RD*, Nos. 17643, 18716 and 307105 as hereinafter listed. Known photographic additives which can be used in the present invention are also described in the same publications as tabulated below.

| Additive | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | p. 648, right column (RC) | |
| 3. Spectral Sensitizer, Supersensitizer | pp. 23–24 | p. 648, RC to p. 649, RC | pp. 866–868 |
| 4. Brightening Agent | p. 24 | p. 648, RC | p. 868 |
| 5. Antifoggant, Stabilizer | pp. 24–25 | p. 649, RC | pp. 868–870 |
| 6. Light Absorbent, Filter Dye, Ultraviolet Absorbent | pp. 25–26 | p. 649, RC to P. 650, left column (LC) | p. 873 |
| 7. Stain Inhibitor | p. 25, RC | p. 650, LC to RC | |
| 8. Dye Image Stabilizer | p. 25 | p. 650, LC | p. 872 |
| 9. Hardening Agent | p. 26 | p. 651, LC | pp. 874–875 |
| 10. Binder | p. 26 | " | pp.873–874 |
| 11. Plasticizer, Lubricant | p. 27 | P. 650, RC | p. 876 |
| 12. Coating Aid, Surface Active Agent | pp. 26–27 | " | p. 875–876 |
| 13. Antistatic Agent | p. 27 | " | pp. 876–877 |

Various color couplers can be used in the present invention, and the three silver halide emulsion layers are preferably a layer containing at least cyan coupler, a layer containing at least magenta coupler, and a layer containing at least yellow coupler. Examples of suitable color couplers are described in *RD*, No. 17643, VII-C to G. Two or more couplers which form dyes having different hue may be added to one lightsensitive layer. For example, the color light-sensitive material according to the present invention may comprise a layer containing a cyan coupler and a magenta coupler, a layer containing a magenta coupler and a yellow coupler, and a layer containing a yellow coupler and a cyan coupler.

As a coupler used in the present invention, 2-equivalent color couplers having the coupling site thereof substituted with a releasable group are more preferred than 4-equivalent color couplers whose coupling site is a hydrogen atom because the former can reduce the silver amount for coating.

Suitable yellow couplers to be used typically includes oil-protected type acylacetamide couplers. Specific examples of these couplers are given in U.S. Pat. Nos. 2,407,210, 2,875,057, and 3,265,506. Two-equivalent yellow couplers are preferred as mentioned above. Included in these couplers are yellow couplers of oxygen-release type described in U.S. Pat. Nos. 3,408,194, 3,447,928, 3,935,501, and 4,022,620; and nitrogen-release type yellow couplers described in JP-B-5810739, U.S. Pat. Nos. 4,401,752 and 4,326,024, *RD*, 18053 (Apr., 1979), British Pat. No. 1,425,020, and West German Pat. OLS Nos. 2,219,917, 2,261,361, 2,329,587, and 2,433,812. In particular, α-pivaloylacetanilide couplers produce dyes having excellent stability especially against light, and α-benzoylacetanilide couplers produce dyes having high color nidensity.

Suitable magenta couplers to be used in this invention include oil-protected type 5-pyrazolone couplers and pyrazoloazole couplers such as pyrazolotriazoles. The 5-pyrazolone couplers are preferably substituted with an arylamino group or an acylamino group at the 3-position thereof in view of the hue or density of a developed color. Typical examples of such 5-pyrazolone couplers are described in U.S. Pat. Nos. 2,311,082, 2,343,703, 2,600,788, 2,908,573, 3,062,653, 3,152,896, and 3,936,015. Releasable groups of 2-equivalent 5-pyrazolone couplers preferably include nitrogen-releasable groups described in U.S. Pat.

No. 4,310,619 and arylthio groups described in U.S. Pat. No. 4,351,897. Further, 5-pyrazolone couplers having a ballast group described in European Pat. No. 73,636 provide high color density.

Suitable pyrazoloazole couplers include pyrazolobenzimidazoles described in U.S. Pat. No. 3,369,879, and preferably pyrazolo[5,1-c][1,2,4]triazoles described in U.S. Pat. No. 3,725,067, pyrazolotetrazoles described in *RD*, 24220 (Jun., 1984), and pyrazolopyrazoles described in *RD*, 24230 (Jun., 1984). From the standpoint of reduction in undesired yellow absorption and stability of a developed color against light, imidazo[1,2-b]pyrazoles described in European Pat. No. 119,741 are preferred, and pyrazolo[1,5-b][1,2,4] triazole described in European Pat. No. 119,860 is particularly preferred.

Cyan couplers which can be used in the present invention include oil-protected type naphthol and phenol couplers. Typical examples of these cyan couplers are naphthol couplers described in U.S. Pat. No. 2,474,293, and oxygen-release type 2-equivalent naphthol couplers described in U.S. Pat. Nos. 4,052,212, 4,146,396, 4,228,233, and 4,296,200. Examples of phenol couplers are described in U.S. Pat. Nos. 2,369,929, 2,801,171, 2,772,162, and 2,895,826. Cyan couplers stable to moisture and heat are preferably used in the present invention. Typical examples of such couplers include phenol cyan couplers having an alkyl group having at least two carbon atoms at the m-position of the phenol nucleus described in U.S. Pat. No. 3,772,002, 2,5-diacylamino-substituted phenol couplers described in U.S. Pat. Nos. 2,772,162, 3,758,308, 4,126,396, 4,334,011, and 4,327,173, 4,500,635, West German Pat. OLS No. 3,329,729, and phenol couplers having a phenylureido group at the 2-position and an acylamino group at the 5-position described in U.S. Pat. Nos. 3,446,622, 4,333,999, 4,451,559, and 4,427,767.

From the standpoint of performance demanded for color filters, such as stability to temperature and humidity and the hue developed, 2,5-diacylamino-substituted phenol couplers are preferred.

Dye-forming couplers may be in the form of a polymer. Typical examples of dye-forming couplers in a polymer form are described in U.S. Pat. Nos. 3,451,820, 4,080,211, and 4,367,282, and British Pat. No. 2,102,173.

Couplers capable of releasing a photographically useful residue on coupling are also used to advantage. Examples of suitable DIR couplers which release a development inhibitor are described in *RD*, No. 17643, Items VII-F, JP-A-57-151944, JP-A-57-154234, JP-A-60-184248, and U.S. Pat. No. 4,248,962.

Examples of suitable couplers which imagewise release a nucleating agent or a development accelerator at the time of development are described in British Pat. Nos. 2,097,140 and 2,131,188, JP-A-59-157638, and JP-A-59-170840.

Couplers which can be additionally used in the lightsensitive material of the present invention include competing couplers described in U.S. Pat. No. 4,130,427; polyequivalent couplers described in U.S. Pat. Nos. 4,283,472, 4,338,393, and 4,310,618; couplers capable of releasing a DIR redox compound described in JP-A-60-185950; and couplers capable of releasing a dye which restores its color after release described in EP-A-173302.

The light-sensitive material of the present invention preferably contains the compound described in EP-A2-0277589, which serves for improving dye image preservability, in a coupler-containing layer. The compound disclosed is particularly effective when used in combination with pyrazoloazole magenta couplers. EP-A2-0277589 discloses compound (F) which chemically reacts with an aromatic amine developing agent remaining after color development to form a chemically inert and substantially colorless compound and compound (G) which chemically reacts with an oxidation product of an aromatic amine developing agent remaining after color development to form a chemically inert and substantially colorless compound. Therefore, use of compound (F) and/or compound (G) is effective to prevent the color developing agent or an oxidation product thereof remaining in a film after processing from further reacting with couplers during preservation to cause stains or any other unfavorable side effects.

The light-sensitive material according to the present invention may contain a hydroquinone derivative, an aminophenol derivative, a gallic acid derivative or an ascorbic acid derivative as a color fog inhibitor.

In order to prevent fading of a cyan dye image due to heat and particularly light, it is effective to incorporate an ultraviolet absorbent to the cyan color forming layer and the layers adjacent thereto on both sides. Suitable ultraviolet absorbents include aryl-substituted benzotriazole compounds (e.g., those described in U.S. Pat. No. 3,533,794); 4-thiazolidone compounds (e.g., those described in U.S. Pat. Nos. 3,314,794 and 3,352,681); benzophenone compounds (e.g., those described in JP-A-46-2784); cinnamic ester compounds (e.g., those described in U.S. Pat. Nos. 3,705,805 and 3,707,395); butadiene compounds (e.g., those described in U.S. Pat. No. 4,045,229); and benzoxazole compounds (e.g., those described in U.S. Pat. Nos. 3,406,070 and 4,271,307). Ultraviolet-absorbing couplers (e.g., α-naphthol cyan couplers) or ultravioletabsorbing polymers are also useful. These ultraviolet absorbents may be mordanted in a specific layer. Of these ultraviolet absorbents preferred are aryl-substituted benzotriazole compounds.

It is preferable to add to a hydrophilic colloidal layer of the light-sensitive material an antimicrobial or antifungal agent, such as the compound disclosed in JP-A-63-271247, so as to prevent various bacteria and mold from proliferating to cause image deterioration.

The couplers are introduced into light-sensitive materials by various known dispersion methods.

High-boiling solvents which are useful in an oil-in-water dispersion method are described in, e.g., U.S. Pat. No. 2,322,027.

With respect to a latex dispersion method, the steps involved, the effects, and specific examples of impregnating latices are described in U.S. Pat. No. 4,199,363 and West German Pat. (OLS) Nos. 2,541,274 and 2,541,230.

The coupler-in-developer type light-sensitive materials use no hydrophobic couplers but couplers soluble in a developer, and the developer-soluble couplers are added to a color developer but not to a light-sensitive material. Specific examples of such couplers are described in JP-A-64-79701.

Internal latent image type emulsions and their silver halide grains which can be used in direct positive lightsensitive materials, such as auto positive color films and auto positive color paper, are described in JP-A-63-81337 and JP-A-1-282545.

The internal latent image type emulsion may be either a conversion type emulsion or a core/shell type emulsion, with the latter being preferred.

It is preferred that the light-sensitive material of the present invention is a direct positive light-sensitive material having a silver halide emulsion which is a beforehand unfogged internal latent image type silver halide emulsion.

With respect to direct positive light-sensitive materials, the details of useful color couplers are described in JP-A-63-81337, pp. 19–27, and the details of various compounds which can be used in the light-sensitive material, such as color fog inhibitors, discoloration inhibitors, and dyes, are described in the same specification, pp. 28–30.

Examples of suitable support which can be used in the color light-sensitive materials are described, e.g., in *RD*, No. 17632, p. 28, and ibid, No. 18716, pp. 647 (right column) to 648 (left column). The surface of the support may be subjected to undercoating processing and/or be subjected to a surface treatment, such as a glow discharge treatment, a corona discharge treatment, ultraviolet irradiation, and the like. Further, the back surface may be coated with, e.g., carbon black in order to improve heat and electric conductivities.

The light-sensitive materials can be development processed according to usual methods as described in *RD*, No. 17643, pp. 28–29 and ibid, p. 615, left to right columns.

After exposure, the light-sensitive material of the present invention is processed by, for example, color development, followed by desilvering, followed by washing. Desilvering is effected by bleaching using a bleaching bath and fixing using a fixing bath, or bleaching and fixing may be replaced with bleach-fix using a bleach-fix bath. Bleaching, fixing, and bleach-fix may be combined in an arbitrary order. Washing may be replaced with or followed by stabilization. Color development, bleach, and fixing, may be performed by combined color developing, bleaching and fixing using a monobath. These processing steps may be combined with prehardening, neutralization for the prehardener, stopping and fixing, post hardening, compensation, intensification, and the like. A so-called activator processing step may be conducted instead of color development.

In addition to the aforementioned color couplers, nondiffusion dye-donating compounds capable of releasing a diffusing dye in correspondence or reverse correspondence to the reduction reaction of silver halide to silver can also be used as dye image-forming compounds in the light-sensitive material for color filters. Specific examples of such dyedonating compounds are described in JP-A-59-185333, JP-A-63-201653, EP-B-220746, and U.S. Pat. Nos. 4,500,626, 4,639,408, 4,783,396, 4,232,107, 4,619,884, 4,450,223, 4,503,137, and 4,559,290.

The light-sensitive material containing the abovementioned dye-donating compound is processed in accordance with the methods described in U.S. Pat. No. 3,923,510, West German Pat. OLS No. 2,916,582, JP-A-54-143230, and Japanese Pat. Application No. 205554/93 to provide a color filter having a dye image formed of the released dye.

The coupler-in-emulsion type light-sensitive material of the present invention preferably has a total thickness of 20 μm or less, more preferably from 5 to 15 μm. The couplerin-developer type light-sensitive material of the present invention preferably has a total thickness of 15 μm or less, more preferably from 3 to 10 μm.

The pattern exposure system which can be used in the present invention includes a planar exposure system and a scanning exposure system. The scanning system includes a line (slit) scanning system and a point scanning system using a leaser beam, etc.

Examples of a light source include tungsten lamp, halogen lamp, fluorescent lamp (e.g., three wavelengths type fluorescent lamp), laser lamp, and light emitting diode. Preferred are halogen lamp, fluorescent lamp and laser lamp.

In exposure, band stop filter described in U.S. Pat. No. 4,880,726 is preferably used to remarkably improve color reproducibility by removing light contamination.

In using a direct positive color light-sensitive material, the material after pattern exposure is subjected to color development with a surface developing solution containing an aromatic primary amine color developing agent preferably at a pH of 12 or lower, particularly between 11.0 and 10.0, either after or simultaneously with fogging by light or a nucleating agent, followed by bleaching and fixing to form a direct positive color image.

Fogging in this embodiment may be effected by either a method called light fogging in which the entire surface of a light-sensitive layer is subjected to second exposure or a method called chemical fogging in which a light-sensitive material is developed in the presence of a nucleating agent. Development may be conducted in the presence of both a nucleating agent and fogging light. Further, a light-sensitive material containing a nucleating agent may be subjected to fogging exposure.

Details of the light fogging method are described in JP-A-63-81337, p. 33, 1.17 to p. 35, the last line, and details of the useful nucleating agents are described in the same specification, pp. 50–53. Preferred nucleating agents are those represented by formulae (N-I) and (N-II) shown in that specification.

Further, nucleation accelerators which can be used in the present invention are also described in the same specification. Preferred nucleation accelerators are Compound Nos. (A-1) to (A-13) shown on pages 55 to 57.

The color filter produced by the process of the present invention may have a heat- and water-resistant (organic solvent-resistant) protective (overcoating) layer having a high specific resistance as an outermost layer. Examples of the resins providing such a protective layer are described in U.S. Pat. Nos. 4,698,295 and 4,668,601, EP-A-179636, EP-A-556810, and JP-A-3-163416, JP-A-3-188153, JP-A-5-78443, JP-A-1-27610, JP-A-60-216307 and JP-A-63-218771. It is preferred that the color filter obtained has little unevenness on the surface thereof, and, for example, it is desirable that the unevenness is from −0.1 μm to 0.1 μm.

If necessary, a transparent electrode, such as an indium-tin oxide layer (ITO), may be provided on the color filter by deposition, for example, by vacuum evaporation or sputtering. Further, orientation layer, such as polyimide resin, may be provided thereon.

If desired, a polarizer or a phase retarder may be provided on the light-transmitting substrate of the color filter on its side opposite to the emulsion layer.

A color liquid crystal display (hereinafter abbreviated as LCD) using the color filter according to the present invention will be described below.

In FIG. 1 is shown a schematic cross section of an example of LCD. Color filter 2, which is formed on glass substrate 1 according to the Example, is covered with a protective film (not shown) made of the above-mentioned resin. Transparent electrode, e.g., an indium-tin oxide (ITO) electrode, is formed on the protective film by means of a vacuum film-forming apparatus. Transparent electrode 3 is usually provided on the entire surface of the color filter in the case of active matrix-driven LCD using a three-terminal switching array like TFT or in the stripe form in the case of simple matrix-driven LCD or active matrix-driven LCD using a two-terminal switching array like MIM. On transparent electrode 3 is provided orientation layer 4 comprising polyimide, etc. for alignment of liquid crystal molecules.

The ITO-glass substrate having color filter 3 is assembled with another glass substrate 7 having formed thereon transparent electrode (e.g., an ITO electrode) and layer 4 in this order via spacers (not shown) and sealing material 6 with both alignment layers facing to each other. In the case of active matrix-driven LCD using a three-terminal switching array like TFT, transparent electrode 8 forms pixels connected with TFT elements. In the case of simple matrix-driven LCD, such as STN mode LCD, transparent electrode 8 usually has the form of stripes crossing the stripes of transparent electrode 3 on the other side.

Black matrix 9 is usually formed among R, G, and B pixels to improve contrast or color purity. Black matrix 9 can be formed simultaneously with the formation of R, G, and B pixels, or a chromium film or a carbon film may be formed separately. Polarizers 10 and 11 are placed on the back side of glass substrates 1 and 2, respectively. If desired, a phase compensator (not shown) may be provided between each glass substrate and the polarizer.

Because the LCD using a color filter has a low light transmission, back light 12 is usually placed as a light source which matches the color filter in color reproduction.

A plastic film having a gas barrier layer or a hard coating layer may be used in place of the above-described glass substrate as a light-transmitting substrate.

For the details of color LCD and methods for producing color LCD, reference can be made to Matsumoto Sho-ichi and Tsunoda Nagayoshi, *Ekisho no kiso to o-yo (Basis and Application of Liquid Crystal)*, Kogyo Chosakai Publishing Co., Ltd. (1991), Nikkei Microdevice (ed.), *Flat Panel Display* 1994, Nikkei Business Publications, Inc. (1993), and JP-A-1-114820.

The present invention will now be illustrated in greater detail with reference to the following examples, but it should be understood that the present invention is not construed as being limited thereto. All percents are by weight unless otherwise indicated.

EXAMPLE 1

Layers from 1st to 9th shown below were applied simultaneously on a 100 μm thick polyethylene terephthalate film having a gelatin subbing layer to prepare a multi-layer color light-sensitive material (designated sample A). In the following layer structure, the numeral for each component is the spread in terms of gram per $m^2$. The spreads of silver halide emulsions and colloidal silver emulsions are expressed in terms of silver amount (g) per $m^2$. The emulsions used were prepared by the method for preparing emulsion EM-1 hereinafter described.

| | |
|---|---|
| 1st Layer (Peeling Layer): | |
| Hydroxyethyl cellulose | 0.50 |
| 2nd Layer (Gelatin Layer): | |
| Gelatin | 0.50 |
| 3rd Layer (Blue-Sensitive Layer): | |
| Silver bromide (average grain size: 0.45 μm; size distribution: 8%; octahedral grains) spectrally sensitized with blue-sensitizing dyes (ExS-5 & 6) | 0.54 |
| Gelatin | 1.64 |
| Yellow coupler (EXY-1) | 1.02 |
| Discoloration inhibitor (Cpd-12) | 0.13 |
| Stain inhibitor (Cpd-7) | 0.06 |
| Polymer (Cpd-13) | 0.12 |

-continued

| | |
|---|---|
| High-boiling solvent (Solv-4) | 0.36 |
| 4th Layer (Intermediate Layer): | |
| Gelatin | 1.13 |
| Color mixing inhibitor (Cpd-3) | 0.08 |
| High-boiling solvent (Solv-1) | 0.05 |
| High-boiling solvent (Solv-2) | 0.12 |
| UV Absorbent (Cpd-1) | 0.01 |
| UV Absorbent (Cpd-8) | 0.02 |
| UV Absorbent (Cpd-9) | 0.06 |
| UV Absorbent (Cpd-10) | 0.04 |
| Polymer (Cpd-11) | 0.05 |
| Yellow dye (YF-1) | 0.15 |
| 5th Layer (Green-Sensitive Layer): | |
| Silver bromide (average grain size: 0.32 μm; size distribution: 8%; octahedral grains) spectrally sensitized with green-sensitizing dye (ExS-4) | 0.42 |
| Gelatin | 1.61 |
| Magenta coupler (ExM-1) | 0.41 |
| Discoloration inhibitor (Cpd-4) | 0.46 |
| Stain inhibitor (Cpd-5) | 0.02 |
| Stain inhibitor (Cpd-6) | 0.04 |
| Discoloration inhibitor (Cpd-7) | 0.06 |
| High-boiling solvent (Solv-2) | 1.11 |
| High-boiling solvent (Solv-3) | 0.29 |
| 6th Layer (Intermediate Layer): | |
| Gelatin | 1.13 |
| Color mixing inhibitor (Cpd-3) | 0.08 |
| High-boiling solvent (Solv-1) | 0.05 |
| High-boiling solvent (Solv-2) | 0.13 |
| 7th Layer (Red-Sensitive Layer): | |
| Silver bromide (average grain size: 0.3 μm; size distribution: 8%; octahedral grains) spectrally sensitized with red-sensitizing dyes (ExS-1, 2 & 3) | 0.38 |
| Gelatin | 1.89 |
| Cyan coupler (ExC-1) | 0.33 |
| Cyan coupler (ExC-2) | 0.37 |
| Discoloration inhibitor (Cpd-1) | 0.05 |
| Discoloration inhibitor (Cpd-2) | 0.12 |
| High-boiling solvent (Solv-1) | 0.35 |
| 8th Layer (Irradiation-Preventive Dye Layer): | |
| Gelatin | 0.72 |
| Irradiation preventive dyes (a mixture of Dye-1, 2, 3, and 4 at a molar ratio of 10:10:13:15) | 0.04 |
| 9th Layer (Protective Layer): | |
| Gelatin | 0.70 |
| Colloidal silver emulsion (average grain size: 0.02 μm) | 0.20 |
| Surface active agent (Cpd-14) | 0.06 |
| Hardening agent (H-1) | 0.12 |

Preparation of Emulsion EM-1:

An aqueous solution of potassium bromide and an aqueous solution of silver nitrate were simultaneously added to an aqueous gelatin solution at 60° C. with vigorous stirring over a period of 8 minutes to form octahedral silver bromide grains having an average grain size of 0.15 μm. During the grain formation, 0.3 g, per mole of silver, of 3,4-dimethyl-1,3-thiazoline-2-thione was added to the system. To the resulting emulsion were added successively 6 mg of sodium thiosulfate and 7 mg of chloroauric acid tetrahydrate per mole of silver, followed by heating at 75° C. for 80 minutes to carry out chemical sensitization. The thus formed grains were allowed to grow under the same precipitation conditions as above to finally obtain a mono-dispersed emulsion of octahedral core/shell silver bromide grains having an average particle size of 0.32 μm. The coefficient of variation of the grain size was about 8%. To the emulsion were added 1.5 mg of sodium thiosulf ate and 1.5 mg of chloroauric acid tetrahydrate per mole of silver, followed by heating at 60° C. for 60 minutes to obtain an internal latent image type silver halide emulsion.

Each of the light-sensitive layers of sample A further contained nucleating agents ExZK-1 and ExZK-2 in an amount of $10^{-3}$% and $10^{-2}$%, respectively, and a nucleation accelerator Cpd-15 in an amount of $10^{-2}$%, each based on the silver halide. The light-sensitive layers each furthermore contained a silver halide stabilizer Cpd-16. In addition, each constituting layer contained sodium dodecylbenzenesulfonate as an emulsifying agent or a dispersant, ethyl acetate as an auxiliary solvent, Cpd-17 as a coating aid, and potassium polystyrenesulfonate as a thickener.

Compounds used in the sample preparation were as follows.

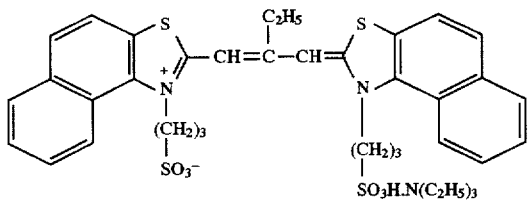

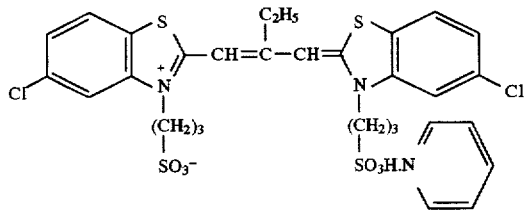

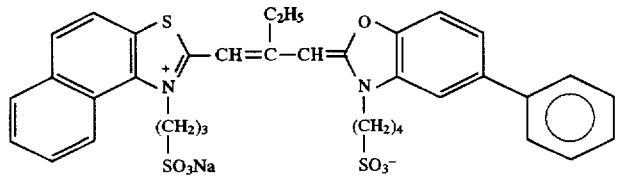

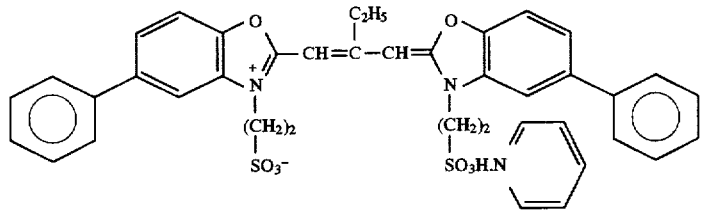

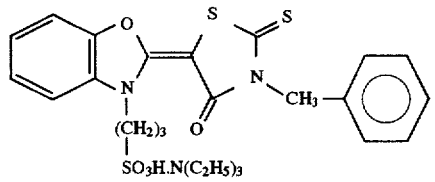

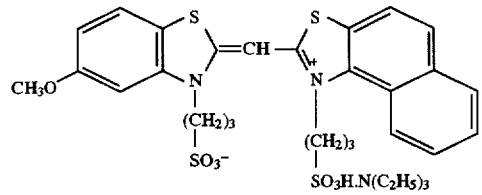

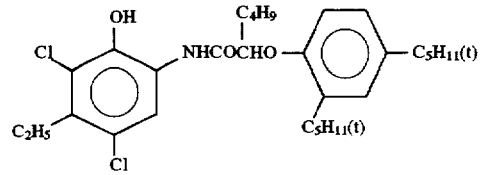

-continued
ExC-2
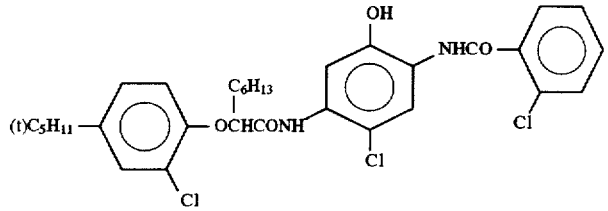
ExM-1
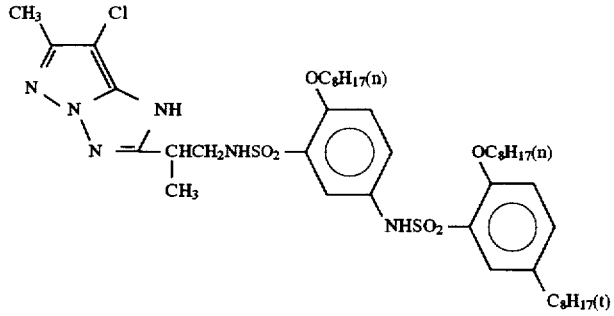
ExY-1
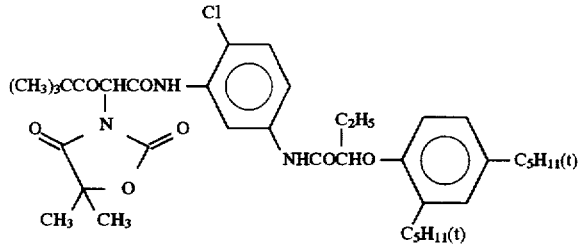
Cpd-1
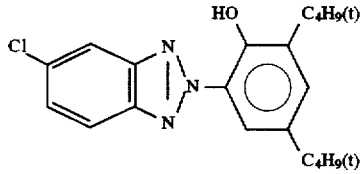
Cpd-2
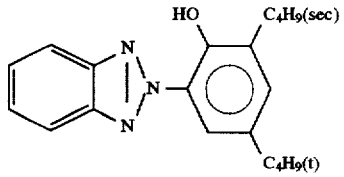
Cpd-3
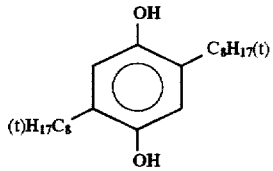
Cpd-4
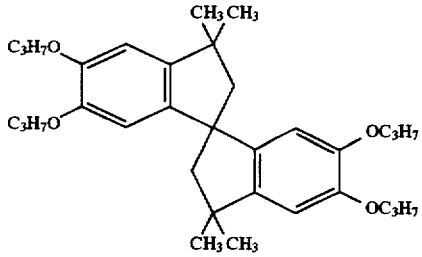

-continued
Cpd-5
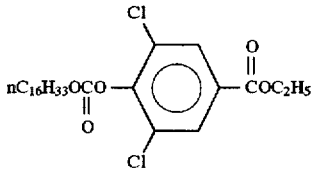
Cpd-6
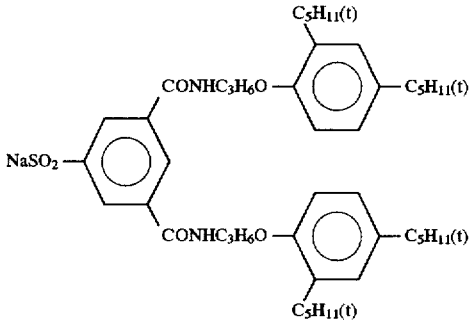
Cpd-7
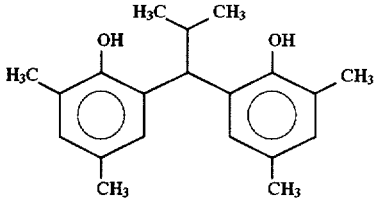
Cpd-8
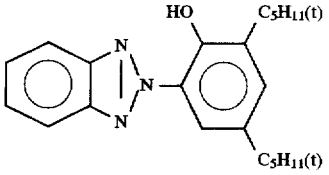
Cpd-9
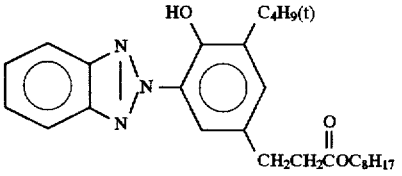
Cpd-10
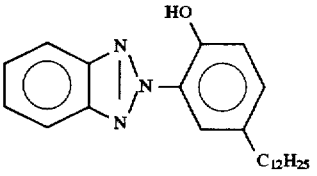
Cpd-11
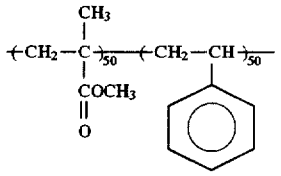
Cpd-12
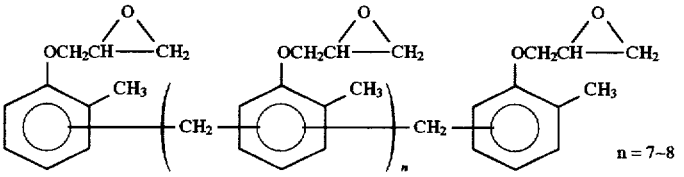

-continued
Cpd-13
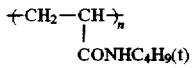
n = 100~1000
Cpd-14
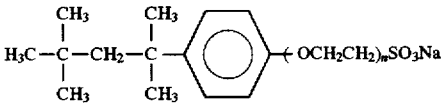
n ≒ 3
Cpd-15
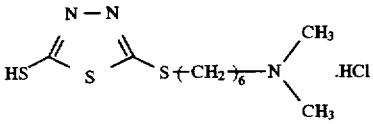
Cpd-16
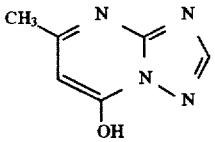
Cpd-17
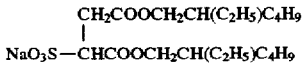
Solv-1
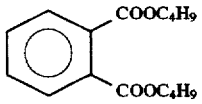
Solv-2
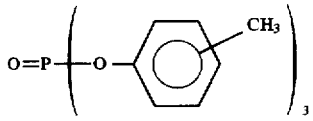
Solv-3
Solv-4
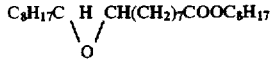
YF-1
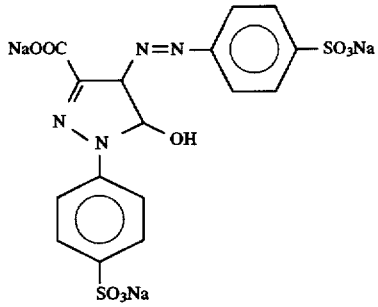
Dye-1
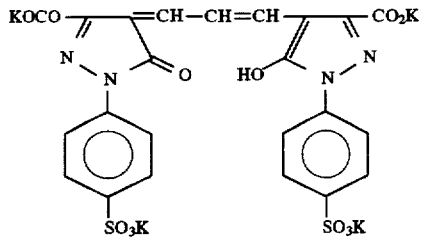

-continued

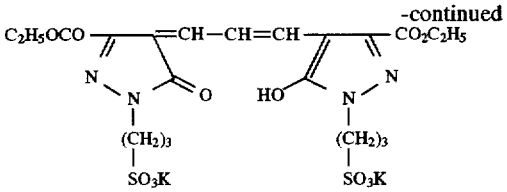

Dye-2

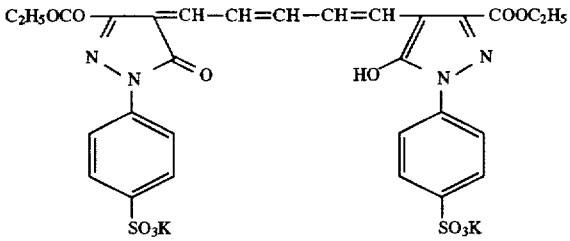

Dye-3

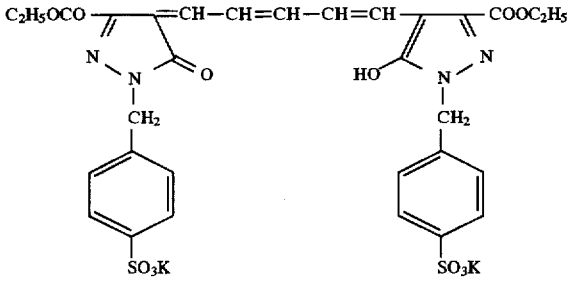

Dye-4

$CH_2=CHSO_2CH_2SO_2CH=CH_2$ H-1

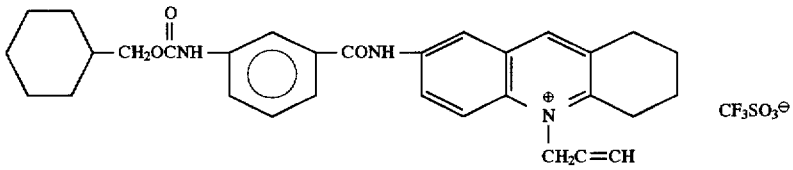

ExZK-1

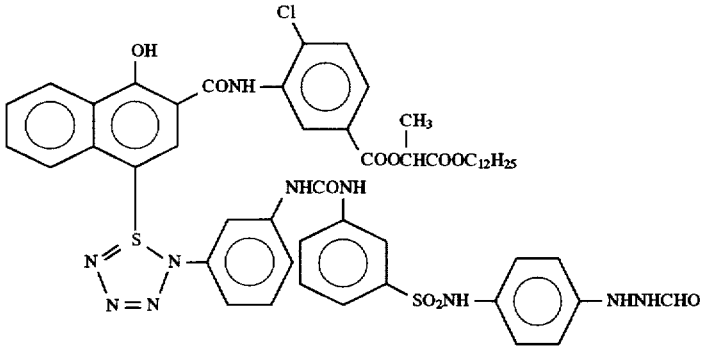

ExZK-2

A 30 cm long, 30 cm wide and 1.1 mm thick transparent substrate made of borosilicate glass was coated with a 1:3 (by weight) mixture of gelatin and colloidal silica (average particle size: 7 to 9 mμ) to which saponin had been added as a surface active agent to a coating thickness of 0.2 μm.

The protective layer of sample A was adhered to the coated surface of the transparent substrate, with slight moisture being supplied to the emulsion side of sample A. The laminate was passed through a laminator set to provide a temperature of about 150° C. to the joint area at a linear speed of 0.45 m/minute. After allowing the laminate to cool to room temperature, the polyethylene terephthalate support of sample A was stripped off. The emulsion layers were found uniformly and intimately adhered to the glass substrate with no defect.

The emulsion layers thus transferred to the glass substrate were exposed to light of a tungsten lamp via a mask for a color filter composed of a blue portion, green portion, red portion, and a black portion and processed according to the following schedule to produce a color filter having three primaries (B, G and R) plus black.

| Processing Step | Temp. | Time |
|---|---|---|
| Hardening | 38° C. | 3 min |
| Washing-1 | 35° C. | 1 min |
| Color development | 38° C. | 5 min |
| Blix | 38° C. | 1 min |
| Washing-2 | 35° C. | 40 sec |

-continued

| Processing Step | Temp. | Time |
|---|---|---|
| Washing-3 | 35° C. | 40 sec |
| Drying | 60° C. | 2 min |

The processing solutions used each had the following compositon.

| | |
|---|---|
| Hardener: | |
| Anhydrous sodium sulfate | 160.0 g |
| Anhydrous sodium carbonate | 4.6 g |
| Formalin (37%) | 20.0 ml |
| Water to make | 1000 ml |
| pH (25° C.) | 10.0 |
| Color Developer: | |
| D-Sorbitol | 0.15 g |
| Sodium naphthalenesulfonate-formalin condensate | 0.15 g |
| Pentasodium nitrilotris (methylenephosphonate) | 1.80 g |
| Diethylenetriaminepentaacetic acid | 0.50 g |
| 1-Hydroxyethylidene-1,1-diphosphonic acid | 0.15 g |
| Diethylene glycol | 12.0 ml |
| Benzyl alcohol | 13.5 ml |
| Potassium bromide | 0.70 g |
| Benzotriazole | 0.003 g |
| Sodium sulfite | 2.40 g |
| Disodium-N,N-bis(sulfonatoethyl)hydroxylamine | 8.0 g |
| Triethanolamine | 6.00 g |
| N-Ethyl-N-(β-methanesulfonamidoethyl)-3 methyl-4-aminoaniline sesquisulfate monohydrate | 6.00 g |
| Potassium carbonate | 30.0 g |
| Water to make | 1000 ml |
| pH (25° C.) | 11.0 |
| Bleach-Fix Bath: | |
| Ethylenediaminetetraacetic acid | 5.0 g |
| Ammonium (ethylenediaminetetraacetato)-iron (II) | 55.0 g |
| Ammonium thiosulfate (750 g/l) | 160 ml |
| Ammonium sulfite | 40.0 g |
| Ammonium nitrate | 10.0 g |
| Water to make | 1000 ml |
| pH (25° C) | 6.0 |

Washing Water:

Deionized water having an electrical conductivity of not more than 5 μS.

The resulting color filter had a pattern of B, G, R having an absorbance of 1.0 to 1.7 in each component of cyan, magenta and yellow, and black having an absorbance of 2.3 to 2.7 in each component, suffering from neither white spot nor loss of color definition.

EXAMPLE 2

A color filter having B, G, R, and black patterns was prepared in the same manner as in Example 1, except that the adhesion of the glass substrate and sample A was carried out by applying a commercially available epoxy type adhesive to the glass substrate in place of the mixture of gelatin and colloidal silica and curing the epoxy adhesive at 40° C.

EXAMPLE 3

A color light-sensitive material (designated sample B) was prepared in the same manner as for sample A, except that the 2nd gelatin layer was not provided. The protective layer of sample B was adhered to a glass substrate in the same manner as in Example 1, and release of the temporary support of sample B was compared with that of sample A. The support of sample A was completely peeled apart at the peeling layer, whereas stripping of the support from sample B was accompanied by peeling of about 10% area of the emulsion layer. It is thus seen that the layer adjacent to the peeling layer is preferably a layer mainly comprising gelatin.

EXAMPLE 4

A gelatin subbing layer was coated on a 100 μm thick polyethylene terephthalate support having a backing layer coated with carbon black dispersed in polyvinyl chloride as described in the example of JP-A-63-293348. Layers from 1st to 10th shown below were applied simultaneously thereon to prepare a multi-layer color light-sensitive material (designated sample C). In the following layer structure, the numeral for each component is the spread in terms of gram per $m^2$. The spreads of silver halide emulsions and colloidal silver emulsions are expressed in terms of silver amount (g) per $m^2$. The compounds used were the same as used in Example 1. All the silver halide emulsions were negatively working silver chlorobromide emulsions.

| | |
|---|---|
| 1st Layer (Peeling Layer): | |
| Hydroxyethyl cellulose | 0.72 |
| Alkyl-terminated polyvinyl alcohol (degree of saponification: 98 mol %; degree of polymerization: 300) | 0.15 |
| 2nd Layer (Gelatin Layer): | |
| Gelatin | 0.45 |
| 3rd Layer (UV Absorbing Layer): | |
| Gelatin | 0.45 |
| UV Absorbent (Cpd-1) | 0.01 |
| UV Absorbent (Cpd-8) | 0.02 |
| UV Absorbent (Cpd-9) | 0.06 |
| UV Absorbent (Cpd-10) | 0.03 |
| Polymer (Cpd-11) | 0.05 |
| 4th Layer (Red-Sensitive Layer): | |
| Silver chlorobromide emulsion (Br content: 25 mol %; average grain size: 0.2 μm) spectrally sensitized with red-sensitizing dye (ExS-11) | 0.50 |
| Gelatin | 1.50 |
| Yellow coupler (ExY-1) | 0.52 |
| Magenta coupler (ExM-1) | 0.25 |
| Dye image stabilizer (Cpd-21) | 0.09 |
| Dye image stabilizer (Cpd-4) | 0.12 |
| Dye image stabilizer (Cpd-22) | 0.01 |
| High-boiling solvent (Solv-1) | 0.25 |
| High-boiling solvent (Solv-2) | 0.07 |
| High-boiling solvent (Solv-3) | 0.14 |
| Compound (Cpd-23) | 0.04 |
| 5th Layer (Intermediate Layer): | |
| Gelatin | 0.90 |
| Color mixing inhibitor (Cpd-3) | 0.04 |
| UV Absorbent (Cpd-1) | 0.02 |
| UV Absorbent (Cpd-8) | 0.04 |
| UV Absorbent (Cpd-9) | 0.12 |
| UV Absorbent (Cpd-10) | 0.06 |
| Polymer (Cpd-11) | 0.10 |
| 6th Layer (Green-Sensitive Layer): | |
| Silver chlorobromide emulsion (Br content: 30 mol %; average grain size: 0.2 μm) spectrally sensitized with green-sensitizing dyes (ExS-12 and 13) | 0.50 |
| Gelatin | 1.20 |
| Cyan coupler (ExC-1) | 0.23 |
| Cyan coupler (ExC-2) | 0.25 |
| Yellow coupler (ExY-1) | 0.60 |

-continued

| | |
|---|---|
| Dye image stabilizer (Cpd-1) | 0.08 |
| Dye image stabilizer (Cpd-9) | 0.04 |
| Dye image stabilizer (Cpd-10) | 0.07 |
| Dye image stabilizer (Cpd-21) | 0.12 |
| Polymer (Cpd-13) | 0.17 |
| High-boiling solvent (Solv-2) | 0.19 |
| High-boiling solvent (Solv-1) | 0.23 |
| 7th Layer (Intermediate Layer): | |
| Gelatin | 0.90 |
| Color mixing inhibitor (Cpd-3) | 0.08 |
| UV Absorbent (Cpd-1) | 0.01 |
| UV Absorbent (Cpd-8) | 0.02 |
| UV Absorbent (Cpd-9) | 0.06 |
| UV Absorbent (Cpd-10) | 0.03 |
| Polymer (Cpd-11) | 0.05 |
| 8th Layer (Blue-Sensitive Layer): | |
| Silver chlorobromide emulsion (Br content: 80 mol %; average grain size: 0.5 μm) spectrally sensitized with blue-sensitizing dye (ExS-14) | 0.47 |
| Gelatin | 1.40 |
| Cyan coupler (ExC-1) | 0.25 |
| Cyan coupler (ExC-2) | 0.28 |
| Magenta coupler (ExM-1) | 0.15 |
| Dye image stabilizer (Cpd-1) | 0.04 |
| Dye image stabilizer (Cpd-9) | 0.05 |
| Dye image stabiiizer (Cpd-10) | 0.07 |
| Dye image stabilizer (Cpd-4) | 0.12 |
| Dye image stabilizer (Cpd-22) | 0.01 |
| Polymer (Cpd-13) | 0.20 |
| High-boiling solvent (Solv-2) | 0.35 |

-continued

| | |
|---|---|
| High-boiling solvent (Solv-3) | 0.16 |
| 9th Layer (Irradiation-Preventive Dye Layer): | |
| Gelatin | 0.50 |
| Irradiation preventive dyes (a mixture of Dye-1, 2, 3, and 4 at a molar ratio of 10:10:13:15) | 0.04 |
| 10th Layer (Protective Layer): | |
| Gelatin | 0.50 |
| Colloidal silver emulsion (average grain size: 0.02 μm) | 0.20 |
| Surface active agent (Cpd-14) | 0.06 |
| Hardening agent (H-1) | 0.25 |

The blue-sensitive layer, green-sensitive layer, and red-sensitive layer further contained Cpd-24 in an amount of $4.0'10^{-6}$ mol, $3.0\times10^{-5}$ mol, and $1.0\times10^{-5}$ mol, respectively, per mole of the corresponding silver halide.

The blue-sensitive layer and green-sensitive layer furthermore contained Cpd-16 in an amount of $1.2\times10^{-2}$ mol and $1.1\times10^{-2}$ mol, respectively, per mole of the corresponding silver halide.

In addition, each constituting layer contained sodium dodecylbenzenesulfonate as an emulsifying agent or a dispersant, ethyl acetate as an auxiliary solvent, Cpd-17 as a coating aid, and potassium polystyrenesulfonate as a thickener.

ExS-11

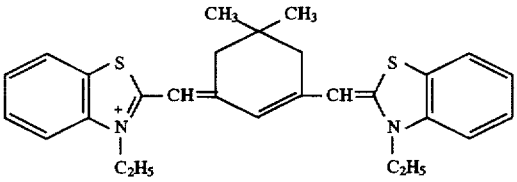

ExS-12

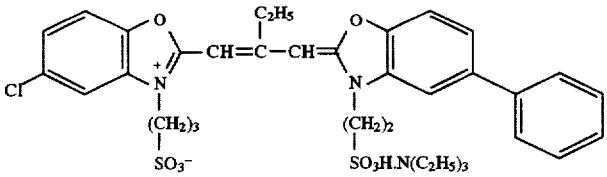

ExS-13

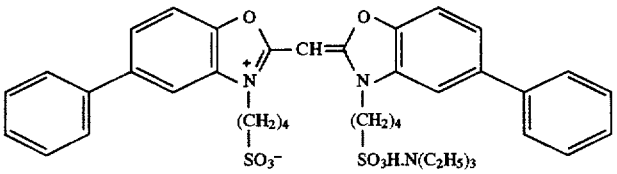

ExS-14

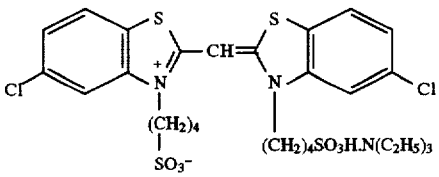

-continued

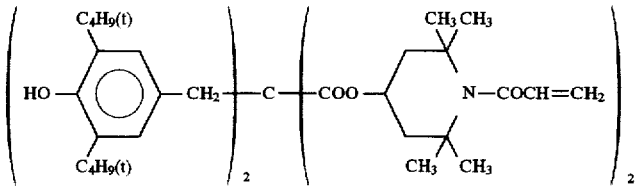

Cpd-21

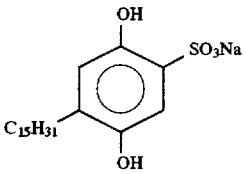

Cpd-22

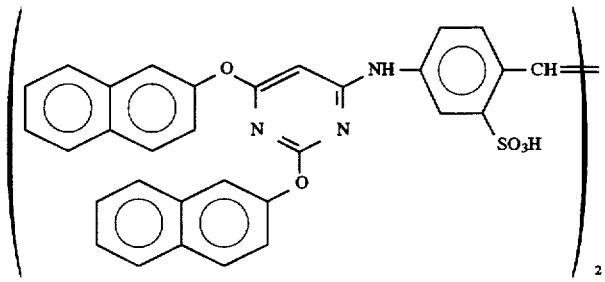

Cpd-23

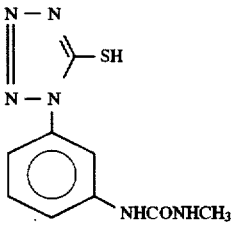

Cpd-24

The emulsion layers of sample C were transferred to the same transparent substrate as used in Example 1 in the same manner as in Example 1. The emulsion layers on the glass substrate were exposed to light of a tungsten lamp via a mask for a color filter composed of a blue portion, a green portion, and a red portion, and processed according to the following schedule to produce a color filter having three primaries (B, G and R) plus black.

| Processing Step | Temp. | Time |
|---|---|---|
| Hardening | 38° C. | 3 min |
| Washing-1 | 35° C. | 1 min |
| Color development | 38° C. | 2.5 min |
| Blix | 38° C. | 1 min |
| Washing-2 | 35° C. | 1 min |
| Washing-3 | 35° C. | 1 min |
| Washing-4 | 35° C. | 30 sec |
| Drying | 80° C. | 1 min |

(Washing-2, 3 and 4 was carried out in a counter-flow system from tank 4 toward tank 2)

The color developer used had the following composition. Other processing solutions each had the same composition as used in Example 1.

| Color Developer: | |
|---|---|
| Water | 800 ml |
| Ethylenediaminetetraacetic acid | 3.0 g |

-continued

| Color Developer: | |
|---|---|
| Disodium 4,5-dihydroxybenzene-1,3-disulfonate | 0.5 g |
| Triethanolamine | 12.0 g |
| Potassium chloride | 6.5 g |
| Potassium bromide | 0.03 g |
| Potassium carbonate | 27.0 g |
| Fluorescent brightening agent WHITEX 4, produced by Sumitomo Chemical Co., Ltd. | 1.0 g |
| Sodium sulfite | 0.1 g |
| Disodium-N,N-bis(sulfonatoethyl)-hydroxylamine | 5.0 g |
| Sodium triisopropylnaphthalene-β-sulfonate | 0.1 g |
| N-Ethyl-N-(β-methanesulfonamidoethyl)-3-methyl-4-aminoaniline sesquisulfate monohydrate | 5.0 g |
| Water to make | 1 l |
| pH (25° C.) | 10.0 |

A color filter having a pattern of B, G, R having an absorbance of 0.9 to 1.6 in each component of cyan, magenta and yellow, and black having an absorbance of 2.2 to 2.9 in each component with neither white spot nor peeling failure was obtained.

As described and demonstrated above, the present invention makes it possible to produce a color filter on a hard light-transmitting substrate such as a glass plate with extreme ease. The color filter obtained comprises a blue portion, a green portion and a red portion each having excellent spectral transmission characteristics and a black portion of high density with good precision suffering from neither loss of color definition nor white spot.

While the invention has been described in detail and with reference to specific examples thereof, it will be apparent to one skilled in the art that various changes and modifications can be made therein without departing from the spirit and scope thereof.

What is claimed is:

1. A micro color filter prepared by a process comprising the steps of:

(i) adhering an emulsion side of a lightsensitive material to a light-transmitting substrate by heating; wherein the light-sensitive material comprises a support having provided thereon a Peeling layer and further provided thereon at least three silver halide emulsion layers which are different in color sensitivity; and wherein the light-transmitting substrate is a glass substrate having a first side and a second side, the side on which the light-sensitive material is to be adhered being precoated with gelatin or a gelatin derivative and colloidal silica;

(ii) peeling the support off the light-sensitive material;

(iii) pattern-exposing the emulsion side of the light-sensitive material;

(iv) hardening processing; and (v) subjecting the light-sensitive material to development processing and desilvering processing.

2. The color filter as claimed in claim 1, wherein the peeling layer mainly comprises a polymer, in which the polymer is other than gelatin or a gelatin derivative and layers other than the peeling layer each contains a binder mainly comprising gelatin or a gelatin derivative.

3. The color filter as claimed in claim 1, wherein a layer mainly comprising gelatin or a gelatin derivative is provided on at least one of the layers directly contacting the peeling layer.

4. The color filter as claimed in claim 1, wherein the peeling layer mainly comprises a cellulose derivative.

5. The color filter as claimed in claim 1, wherein the three silver halide emulsion layers are a layer containing at least a cyan coupler, a layer containing at least a magenta coupler, and a layer containing at least a yellow coupler.

6. The color filter as claimed in claim 1, wherein the light-sensitive material is a direct positive light-sensitive material having a silver halide emulsion which is a before-hand unfogged internal latent image type silver halide emulsion.

7. The color filter as claimed in claim 1; wherein the peeling layer is coated in an amount of from 0.05 to 1.0 $g/m^2$.

* * * * *